US007199320B2

(12) United States Patent
Sato

(10) Patent No.: US 7,199,320 B2
(45) Date of Patent: Apr. 3, 2007

(54) KEY SWITCH DEVICE

(75) Inventor: Tomio Sato, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 11/342,542

(22) Filed: Jan. 31, 2006

(65) Prior Publication Data

US 2006/0266628 A1 Nov. 30, 2006

(30) Foreign Application Priority Data

May 31, 2005 (JP) ..... P2005-160500

(51) Int. Cl.
*H01H 13/14* (2006.01)

(52) U.S. Cl. ..... 200/341; 200/5 A; 400/495

(58) Field of Classification Search ..... 200/341–344, 200/5 A, 5 R, 329; 400/495, 491–492, 496
See application file for complete search history.

(56) References Cited

U.S. PATENT DOCUMENTS 6,586,695 B2 * 7/2003 Sato et al. ..... 200/344
6,683,264 B2 * 1/2004 Obara et al. ..... 200/344

FOREIGN PATENT DOCUMENTS

JP 2001-283675 10/2001

* cited by examiner

*Primary Examiner*—K. Lee
(74) *Attorney, Agent, or Firm*—Whitham, Curtis, Christofferson & Cook, PC

(57) ABSTRACT

A first bearing member is provided on one of an upper face of a board member and a lower face of a key top member. A first guide member is provided on the other one of the upper face of the board member and the lower face of the key top member. A first link member is disposed between the board member and the key top member, and has a first end portion rotatably supported by the first bearing member and a second end portion engaged with the first guide member. The first link member is pivotable in a first direction about the first end portion thereof to allow the key top member to move in a vertical direction. The second end portion of the first link member is slidable relative to the first guide member in a horizontal direction in accordance with the movement of the key top member.

3 Claims, 4 Drawing Sheets

KEY SWITCH DEVICE

BACKGROUND OF THE INVENTION

The present invention relates to a key switch device and more particularly to a key switch device of a link type to be suitably used for a thin keyboard in a personal computer of a notebook type.

For example, Japanese Patent Publication No. 2001-283675A discloses a key switch device of a link type as shown in FIG. 6. In the key switch device, a rubber spring 3 is attached to a portion between a board 1 and a key top 2, and the key top 2 is formed to be movable upward and downward. Furthermore, a small link 4 and a large link 5 which are pivotable in directions orthogonal to each other are provided between the board 1 and the key top 2 so as to not come in contact. The small link 4 is formed by a synthetic resin and the large link 5 is formed by a U-shaped wire.

The small link 4 is slidably attached to a slide guide (not shown) having a lower end provided on an upper face of the board 1. Furthermore, a pivot shaft portion 7 formed at an upper end of the small link 4 is pivotably supported on a pivot support 8 formed with a slit and provided on a back face of the key top 2. In addition, an upper end and a lower end in the large link 5 are pivotably supported on pivot supports 9 and 10 formed on the upper face of the board 1 and the back face of the key top 2, respectively.

The key top 2 is held on the small link 4, the large link 5 and the rubber spring 3 so that a stable stroke in a vertical direction can be secured.

In a Z-link mechanism in the above key switch device, however, upper and lower ends of the large link 5 are pivotably coupled and held on the pivot supports 9 and 10, so that the large link 5 carries out a pivoting motion around a pivot shaft portion thereof held on the pivot support 10 of the board 1. When the key top 2 is pressed down, therefore, it is not moved vertically but is moved in a slightly horizontal direction by a dimension D. Accordingly, it is necessary to carry out a design that secures a key top space corresponding to the dimension D.

Moreover, since a clearance is made between the large link 5 and the key top 2, the clearance generates a looseness of the key top 2.

SUMMARY OF THE INVENTION

It is therefore an object of the invention to provide a key switch device in which a key top is smoothly moved just downward and the looseness of the key top is eliminated when the key top is pressed down.

In order to achieve the above object, according to the invention, there is provided a key switch device, comprising:

a board member;

a key top member;

a first bearing member, provided on one of an upper face of the board member and a lower face of the key top member;

a first guide member, provided on the other one of the upper face of the board member and the lower face of the key top member; and a first link member, disposed between the board member and the key top member, and having a first end portion rotatably supported by the first bearing member and a second end portion engaged with the first guide member, wherein:

the first link member is pivotable in a first direction about the first end portion thereof to allow the key top member to move in a vertical direction; and the second end portion of the first link member is slidable relative to the first guide member in a horizontal direction in accordance with the movement of the key top member.

With this configuration, the key top member which is pressed down can be moved just downward. Therefore, it is possible to reduce a clearance between the adjacent key top members to each other, thereby increasing a key arrangement density. Consequently, it is possible to reduce the size of the whole keyboard. Alternatively, a size of each key top member in the keyboard having a predetermined size can be enlarged, thereby enhancing the operability of the keyboard.

The first bearing member may be formed with a hole rotatably supporting the first end portion of the first link member and a slit communicating with the hole and adapted to be expanded when the first end portion of the first link member is press-fitted into the hole through the slit.

With this configuration, it is possible to easily couple the first link member to the bearing member. Consequently, it is possible to enhance the assembling workability.

The key top device may further comprise rib members, formed on the lower face of the key top member and clamping the first link member in the horizontal direction.

With this configuration, it is possible to reliably prevent a looseness in the horizontal direction of the key top member, and to allow smoother operation for pushing the key top member with a sense of high grade.

The key top device may further comprise:

a second bearing member, provided on one of the upper face of the board member and the lower face of the key top member;

a second guide member, provided on the other one of the upper face of the board member and the lower face of the key top member; and a second link member, disposed between the board member and the key top member, and having a third end portion rotatably supported by the second bearing member and a fourth end portion engaged with the second guide member.

In this case, the second link member is pivotable in a second direction orthogonal to the first direction about the third end portion thereof. The fourth end portion of the second link member is slidable relative to the second guide member in the horizontal direction in accordance with the movement of the key top member.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

A key switch device according to the invention will be described below by taking a preferred example. The best mode of the invention is when one of the ends of a large link is attached to a pivot shaft portion on a back face side of a key top or a slide guide portion on a board side, and furthermore, the other end of the large link is attached to the slide guide portion on the board side or the pivot shaft portion of the back face side of the key top, and a rib (a position regulating member) for suppressing a looseness in a transverse direction of the large link is integrally provided on both left and right sides of the back face of the key top with the large link interposed in the transverse direction.

More specifically, in order to achieve such an object as to obtain a structure in which the key top is smoothly moved just downward and the looseness of the key top is eliminated, the invention is characterized in that an upper end or a lower end of the large link is slid in a horizontal direction while maintaining a parallel state with an upper face of the board and the key top can be thus moved just downward when the key top is pressed down. Moreover, the invention is characterized in that both left and right sides of the large link are interposed and pressed by the rib provided on the back face of the key top and a displacement movement in the transverse direction of the key top with respect to the large link is regulated.

Embodiments of the invention will be described below in detail with reference to the accompanying drawings.

Figure 1A:
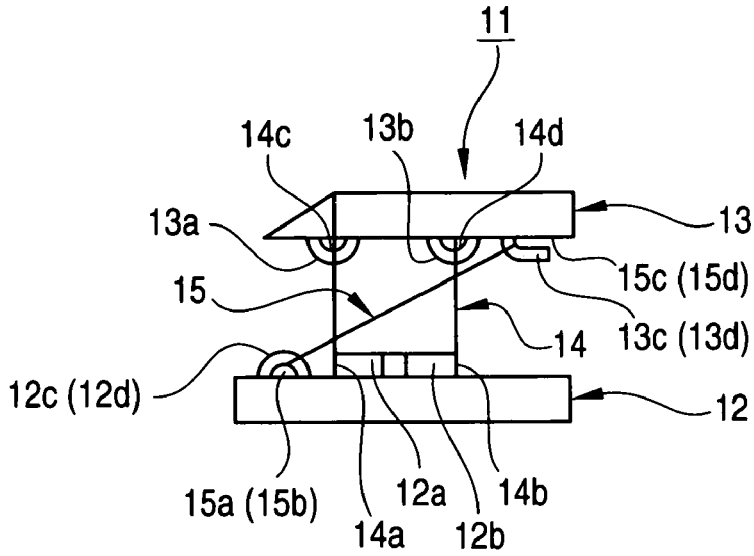
FIG. 1A is a schematic side view of a key switch device according to one embodiment of the invention.
Figure 1B:
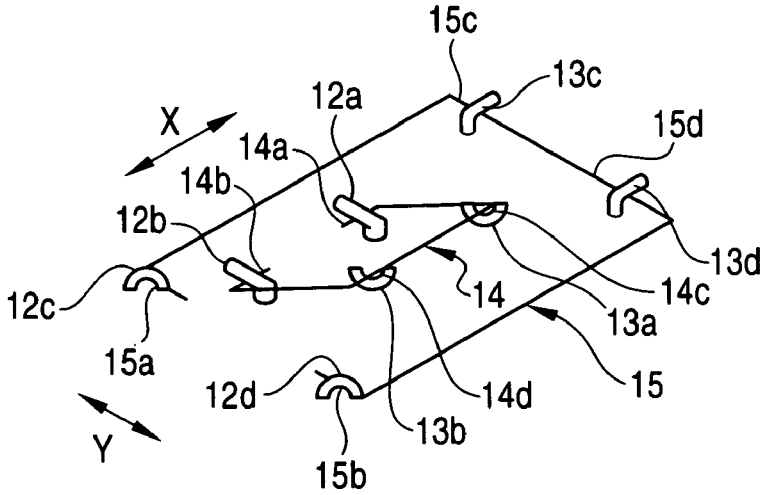
FIG. 1B is a schematic perspective view of the key switch device.

As shown in FIGS. 1A and 1B, a key switch device 11 according to one embodiment comprises a board 12 and a key top 13 provided above the board 12. A small link 14 and a large link 15 are attached between the board 12 and the key top 13. The small link 14 and the large link 15 are constituted to be pivotable in directions orthogonal to each other without any contact.

Lower end portions of the small link 14 are bent in a lateral direction X to form slide shaft portions 14*a* and 14*b*. The slide shaft portions 14*a* and 14*b* are slidably engaged with slide guides 12*a* and 12*b* provided on the board 12, respectively. Upper end portions of the small link 14 are bent in the lateral direction X to form pivot shaft portions 14*c* and 14*d*. The pivot shaft portions 14*c* and 14*d* are pivotably attached to pivot supports 13*a* and 13*b* provided on a back face of the key top 13, respectively.

The slide guides 12*a* and 12*b* guide the lower ends of the small link 14, that is, the slide shaft portions 14*a* and 14*b* in a horizontal direction along the upper face of the board 12 when the key top 13 is moved upward and downward. Moreover, slits provided on the peripheral faces of the pivot supports 13*a* and 13*b* are temporarily expanded when the pivot shaft portions 14*c* and 14*d* of the small link 14 are strongly pressed against the slits from above, and permit the pivot shaft portions 14*c* and 14*d* to be engaged with the inner parts of the pivot supports 13*a* and 13*b*. With this configuration, it is possible to easily couple the small link 14 to the pivot supports 13*a* and 13*b* in the board 12.

Lower ends of the large link 15 are so bent in a lateral direction Y as to form shaft portions 15*a* and 15*b*. The pivot shaft portions 15*a* and 15*b* are pivotably attached to pivot supports 12*c* and 12*d* provided on the board 12, respectively. Upper ends of the large link 15 are so bent in the lateral direction Y as to form slide shaft portions 15*c* and 15*d*. The slide shaft portions 15*c* and 15*d* are slidably engaged with slide guides 13*c* and 13*d* provided on the back face of the key top 13, respectively.

The slide guides 13*c* and 13*d* guide the upper ends of the large link 15, that is, the slide shaft portions 15*c* and 15*d* in a horizontal direction which is parallel with the upper face of the board 12 when the key top 13 is moved upward and downward. Moreover, slits provided on the peripheral faces of the pivot supports 12*c* and 12*d* are temporarily expanded when the pivot shaft portions 15*a* and 15*b* of the large link 15 are strongly pressed against the slits from above, and permit the pivot shaft portions 15*a* and 15*b* to be engaged with the inner parts of the pivot supports 12*c* and 12*d*. With this structure, it is possible to easily couple the large link 15 to the pivot supports 12*c* and 12*d* in the board 12.

Figure 2:
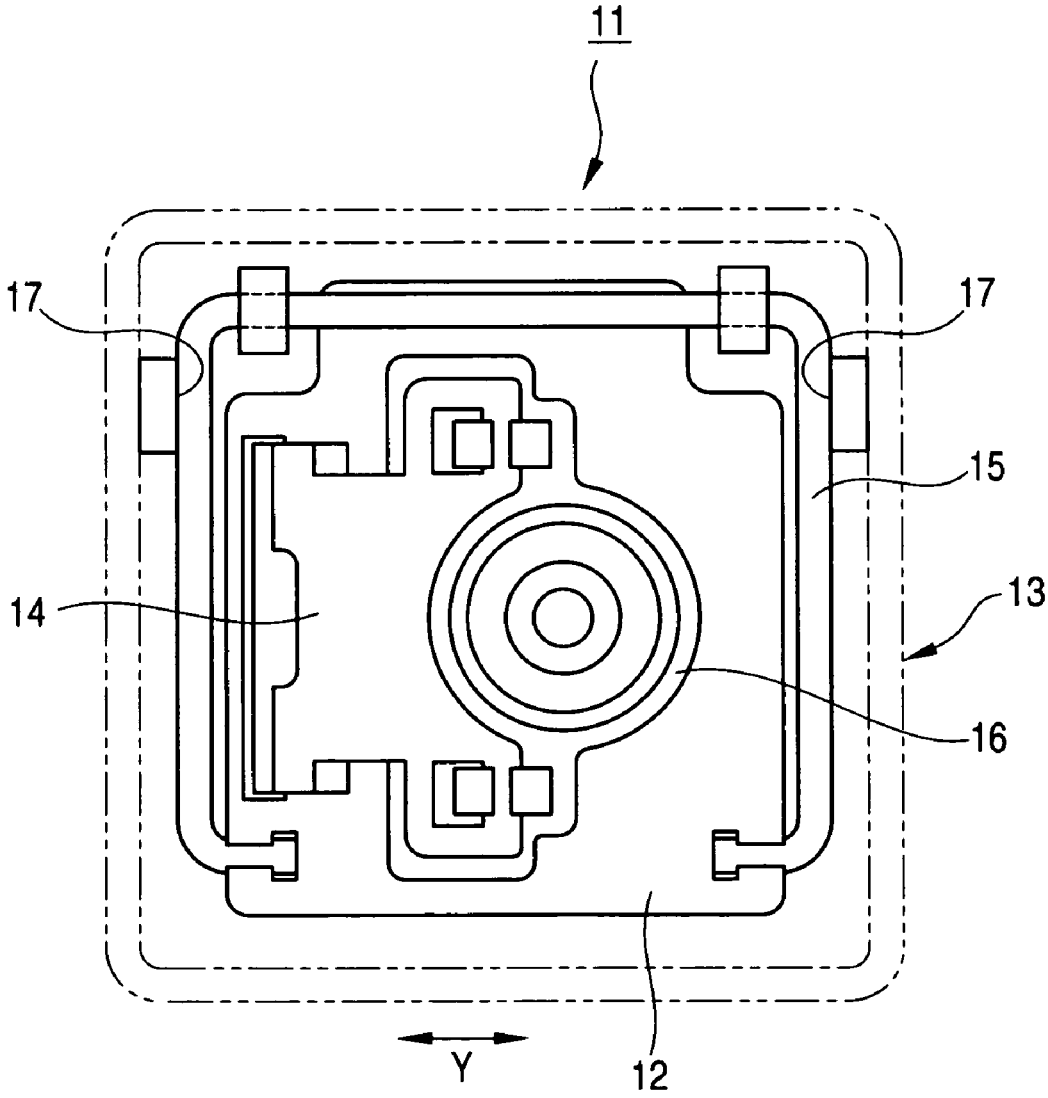
FIG. 2 is a schematic top plan view showing the inside of the key switch device.

As shown in FIG. 2, an almost dome-shaped rubber spring 16 is provided in a central part of the key switch device 11 and is laid over the board 12. Moreover, ribs 17 are provided integrally with the key top 13 so as to protrude inward from both inner peripheral side edges of the back face of the key top 13. The ribs 17 always abut on both left and right sides of the large link 15 coupled to the key top 13 and maintain the large link 15 to be interposed in a transverse direction, and reliably suppress a looseness in the transverse direction of the key top 13 with respect to the large link 15.

Figure 3:
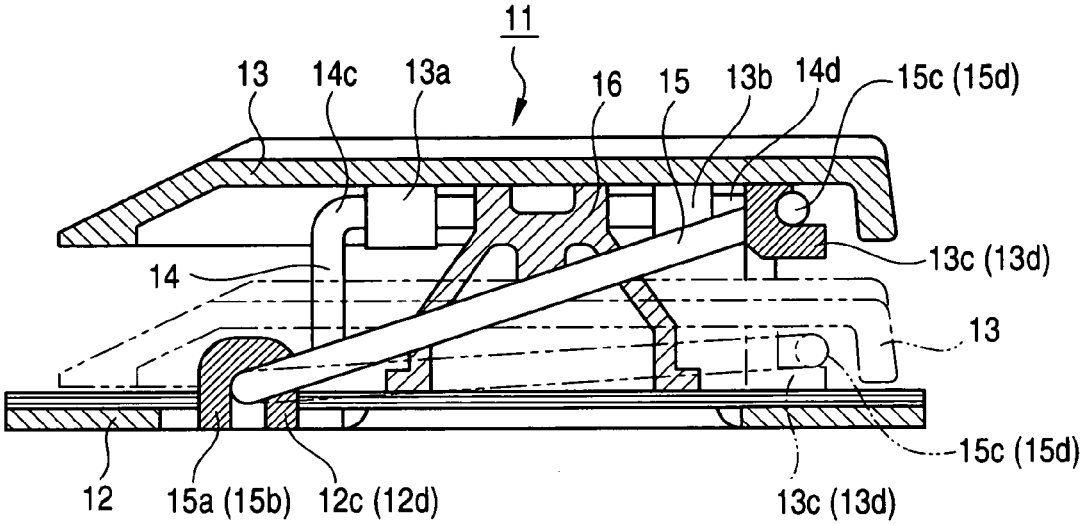
FIG. 3 is a side section view of the key switch device, viewed from the side of a large link.
Figure 4:
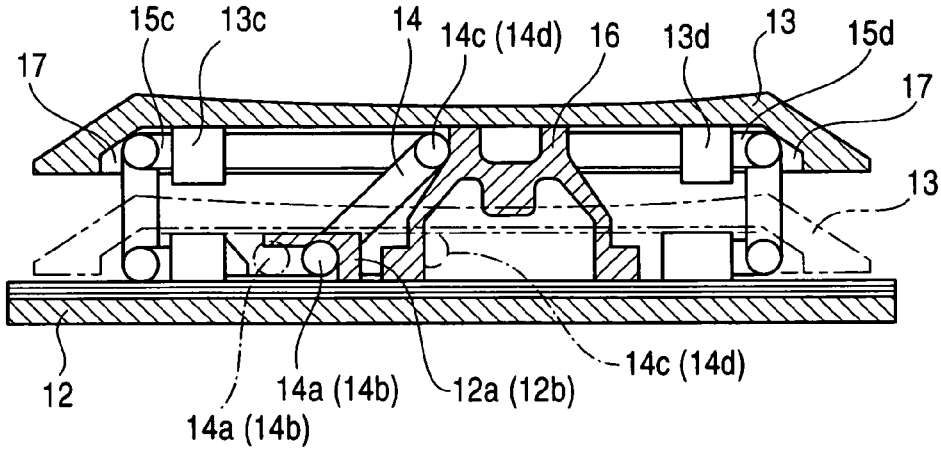
FIG. 4 is a side section view of the key switch device, viewed from the side of a small link.

In FIGS. 3 and 4, a solid line indicates a state before the key top 13 is pressed down. In this state, the rubber spring 16 urges the key top 13 upward so that the small link 14 and the large link 15 also rise at a predetermined angle with respect to the board 12.

When the operator presses down the key top 13 in this state, the key top 13 presses and deforms the rubber spring 16, and furthermore, presses the upper end sides of the small link 14 and the large link 15 downward. At this time, the slide shaft portions 14*a* and 14*b* on the lower end side of the small link 14 are slid along the upper face of the board 12 in the slide guides 12*a* and 12*b* at the board 12 side. At the same time, the pivot shaft portions 14*c* and 14*d* on the upper end side of the small link 14 are rotated in the pivot supports 13*a* and 13*b* on the back face side of the key top 13.

On the other hand, the pivot shaft portions 15*a* and 15*b* on the lower end side of the large link 15 are rotated in the pivot supports 12*c* and 12*d* provided on the board 12. At the same time, the pivot shaft portions 15*c* and 15*d* on the upper end side of the large link 15 are slid in a horizontal direction in parallel with the upper face of the board 12 in the slide guides 13*c* and 13*d* on the key top 13 side. In FIGS. 3 and 4, a dashed chain line indicates a state in which the key top 13 is pressed down.

Accordingly, the key top 13 is pressed just downward while maintaining an almost parallel state with respect to the board 12 by the link function of the small link 14 and the large link 15. The key top 13 is displaced downward to a predetermined position so that the rubber spring 16 presses a switch member 18 provided on the board 12 and is thus conducted electrically.

When the key top 13 is further pressed down to a lowermost point, then, the lower face of the key top 13 abuts on the board 12 so that the operation for pressing the key top 13 down is stopped.

Consequently, it is possible to reduce a clearance between the key tops adjacent to each other, thereby increasing an arrangement density of a large number of keys and reducing a size of the whole keyboard. On the other hand, in a case where a size for the key board is predetermined, it is possible to increase a size of each key top, thereby enhancing the operability of an operator. Furthermore, the movement in the lateral direction of the large link 15 is restricted by the ribs 17 provided on the key top 13. Therefore, it is possible to easily obtain a key switch device in which the key top 13 has no looseness in the lateral direction with respect to the large link 15 and which has an excellent operation feeling and high grade.

Figure 5:
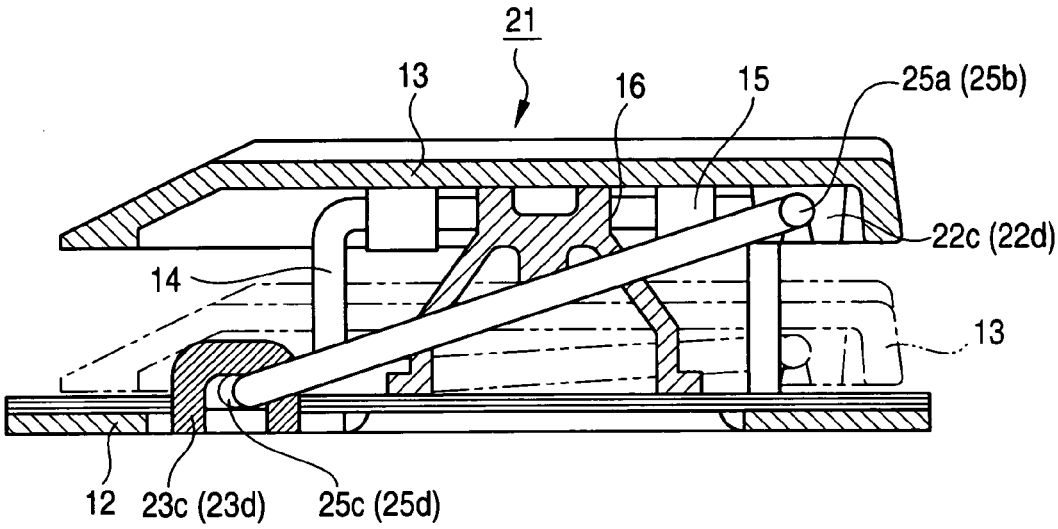
FIG. 5 is a side section view of a modified example of the key switch device, viewed from the side of a large link.
Figure 6:
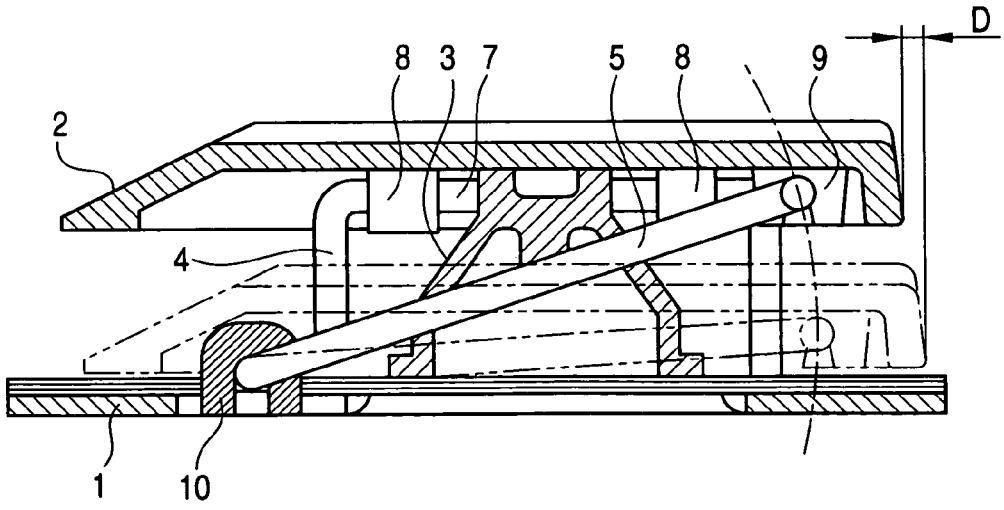
FIG. 6 is a side section view of a related-art key switch device, viewed from the side of a large link.

As a modified example of this embodiment, as shown in FIG. 5, pivot shaft portions 25*a* and 25*b* may be formed on upper ends of a large link 15, and pivot supports 22*c* and 22*d* may be provided on the key top 13. On the other hand, slide shaft portions 25*c* and 25*d* may be formed on lower ends of the large link 15 and slide guides 23*c* and 23*d* may be provided on the board 12.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A key switch device, comprising:

a board member;

a key top member;

a first bearing member, provided on one of an upper face of the board member and a lower face of the key top member;

a first guide member, provided on the other one of the upper face of the board member and the lower face of the key top member;

a first link member, disposed between the board member and the key top member, and having a first end portion rotatably supported by the first bearing member and a second end portion engaged with the first guide member;

a second bearing member, provided on one of the upper face of the board member and the lower face of the key top member;

a second guide member, provided on the other one of the upper face of the board member and the lower face of the key top member; and a second link member, disposed between the board member and the key top member, and having a third end portion rotatably supported by the second bearing member and a fourth end portion engaged with the second guide member, wherein:

the first link member is pivotable in a first direction about the first end portion thereof to allow the key top member to move in a vertical direction;

the second end portion of the first link member is slidable relative to the first guide member in a first horizontal direction in accordance with the movement of the key top member;

the second link member is pivotable in a second direction orthogonal to the first direction about the third end portion thereof; and the fourth end portion of the second link member is slidable relative to the second guide member in a second horizontal direction orthogonal to the first horizontal direction in accordance with the movement of the key top member.

2. The key switch device as set forth in claim 1, wherein the first bearing member is formed with a hole rotatably supporting the first end portion of the first link member and a slit communicating with the hole, wherein the slit is adapted to be expanded when the first end portion of the first link member is press-fitted into the hole through the slit.

3. A key switch device, comprising:

a board member;

a key top member;

a first bearing member, provided on one of an upper face of the board member and a lower face of the key top member;

a first guide member, provided on the other one of the upper face of the board member and the lower face of the key top member;

a first link member, disposed between the board member and the key top member, and having a first end portion rotatable supported by the first bearing member and a second end portion engaged with the first guide member, and rib members, formed on the lower face of the key top member, wherein:

the first link member is pivotable in a first direction about the first end portion thereof to allow the key top member to move in a vertical direction;

the second end portion of the first link member is slidable relative to the first guide member in a first horizontal direction in accordance with the movement of the key top member; and the rib members clamp the first link member in a second horizontal direction orthogonal to the first horizontal direction.

* * * * *